United States Patent [19]

Schmid et al.

[11] Patent Number: 4,557,627

[45] Date of Patent: Dec. 10, 1985

[54] APPARATUS AND METHOD FOR TUNNEL CONSTRUCTION WITH SHIELD DRIVE

[75] Inventors: Walter A. Schmid, Uetikon am See; Hans Bertschinger, Dubendorf, both of Switzerland

[73] Assignee: Locher & Cie AGZZ, Zurich, Switzerland

[21] Appl. No.: 348,650

[22] Filed: Feb. 12, 1982

Related U.S. Application Data

[63] Continuation of Ser. No. 114,090, May 24, 1979.

[51] Int. Cl.[4] ..... E21D 9/06; E21D 11/10

[52] U.S. Cl. ..... 405/146; 405/145

[58] Field of Search ..... 405/141, 143, 145, 146, 405/150

[56] References Cited

U.S. PATENT DOCUMENTS 3,266,257 8/1966 Larrouze et al. ..... 405/146 X 4,155,668 5/1979 Heitkamp et al. ..... 405/145

*Primary Examiner*—David H. Corbin

*Attorney, Agent, or Firm*—Wood, Dalton, Phillips, Mason & Rowe

[57] ABSTRACT

In tunnel construction with shield drive locational concrete is brought in stages directly behind the shield as tunnel lining. In order not to have to interrupt the shield progress during concreting it is proposed to provide a shield tail element consisting of a plurality of lamina movable relative to the shield, in addition to a shield tail element attached rigidly to the shield. This basically stands still during the continuous progress of the shield and is drawn forward into the shield by lamina only during the segment concreting, in order to remain immobile there relative to the earth until the next concreting stage.

2 Claims, 13 Drawing Figures

APPARATUS AND METHOD FOR TUNNEL CONSTRUCTION WITH SHIELD DRIVE

Figure 1:
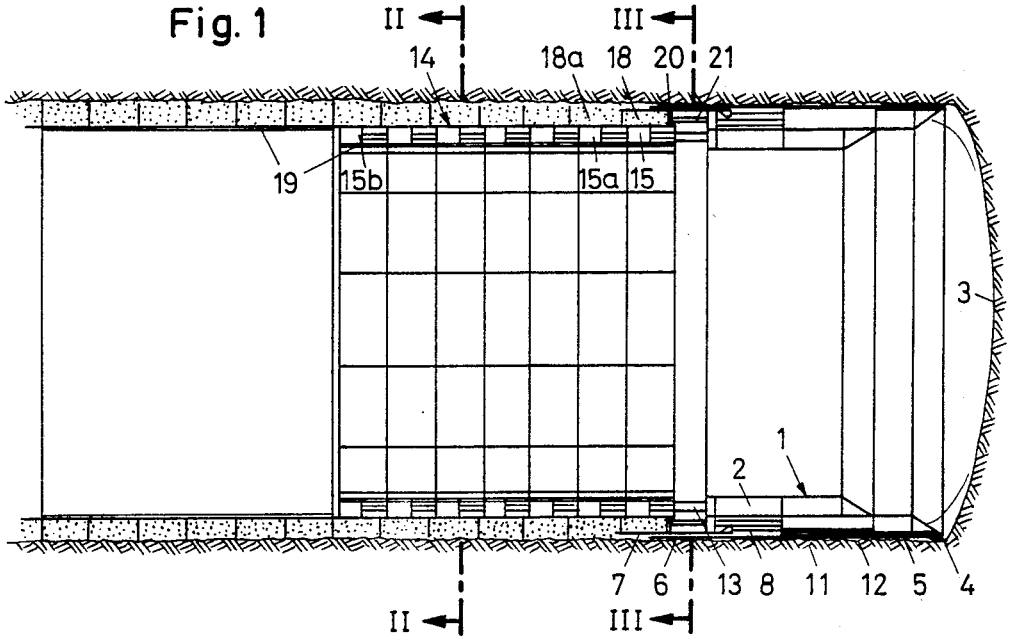

This is a continuation of application Ser. No. 114,090 filed May 24, 1979.

The invention relates to a tunnel construction apparatus having a tunnel shield consisting of cutter, shield casing and shield tail and subsequent framing for the concrete lining.

The invention further relates to a tunnel construction method with shield drive and the incorporation of a concrete tunnel lining directly behind the shield.

Tunnel and adit structures in underground construction in unstable earth are commonly produced using a shield consisting of a cylindrical tube which supports the earth in the construction region and prevents the tunnel from caving in. If necessary, the forward wall of the tunnel is also secured with shield-like plates. As the excavation proceeds the tunnel shield is pushed forward. Behind the tunnel shield the walls of the tunnel must be immediately supported with fitting elements. These fitting elements commonly consist of curved casing or lining plates made of cast iron or ferro-concrete, which are assembled into supporting rings. By subsequently filling the hollow space between the rings and the earth, the pressure of the earth can be transferred onto these rings.

This type of prefabricated linings are expensive to manufacture, and the transport and installation are labor intensive. In the linings made of reinforced concrete, the additional reinforcement necessary for transport durability and for the assumption of the lateral tensions arising from the forward driving pressure is more than 50% of the total reinforcement. It has also been shown that the tunnel walls so lined can deform under the non-uniform influence of the pressure of the earth.

For this reason it has already been suggested to use locational concrete in place of the linings, which is brought in and placed directly behind the shield. This method of operation, however, has until now only been employed in isolated cases and only in tunnel construction of limited diameter. In the process used in this manner, there was always an interruption for the concreting phase in the drive and excavation operations, which is undesirable both technically and organizationally.

It is thus the objective of the invention to create an apparatus and a method of the above-mentioned type in which these disadavantages are avoided. Particularly, it should be possible to continuously push the shield forward despite the stage-like construction of the lining, so that the operations at the front wall of the tunnel do not periodically have to be shut down. By means of the invention it should also be achieved that the reinforcement can at best be entirely eliminated, but at least be substantially reduced.

In the tunnel construction apparatus according to the invention the solution to this objective is found in that the shield tail consists of an element which is rigidly connected with the shield casing and an element which is movable with regard thereto, in that the movable shield tail element is divided into a plurality of lamina, which can be individually drawn forward in the casing, and in that the framing has a plurality of framing rings consisting of curved framing elements.

In an advantageous exemplary embodiment of the invention the framing rings are provided with annular ribs and with longitudinal ribs for the purpose of producing a network of annular indentations and longitudinal indentations in the finished concrete lining. By means of the indentations the arch of the tunnel lining is divided into individual blocks. The indentations form weak joints between these blocks. Under the influence of the pressure of the earth and the resulting deformations, cracks can develop along these indentations which can ease the adaptation of the lining to the deformation earth, because the individual blocks separated from each other by placement cracks become somewhat articulatedly pivotable relative to one another like a lining of individual molded arch stones. An arch reinforcement can thus be entirely eliminated in most cases or at least be strongly reduced, because practically no bending loads are present in these blocks.

The tunnel construction method according to the invention is characterized in that in the basically continuous shield drive, concrete rings of locational concrete are brought in and placed in stages behind the shield, that a framing ring consisting of a pluraltiy of curved framing elements is mounted in segments behind the shield and is connected with an adjacent framing ring, and that the concrete is brought in segments from the base alternately right and left climbing above the sides up to the crown between the framing ring and a shield tail element which is arranged movably with respect to the shield and consists of lamina, whereby during the concreting of one element the last associated lamina of the movable shield tail element is drawn into the shield so that the concrete comes into contact with the earth of the tunnel wall.

Because the concrete may not break into the hollow chamber left behind by the continually moving rigid shield tail element, the progress of the movable shield tail element is interrupted in the area of the setting concrete.

Without the movable shield tail element it would hardly be possible to completely fill the hollow chamber. It might be attempted to subsequently fill this shield tail hollow chamber with injected material. But it would be hard to succeed, even with high pressures, to produce a reliable support between the earth and the concrete arch in such a manner that no concrete elements can break into the injected material, which would weaken the fresh concrete structure. When there is an interruption in the forward drive, the injected material could also harden and jam the shield tail, and at least when the forward drive is again begun the injected material could not properly reach the hole left by the shield tail.

These disadvantages are now avoided by the method according to the invention, because the movable shield tail element stands still with regard to the earth during the continual forward progress of the shield, and is not drawn forward until concrete is added by the length of one stage, and it then again remains immobile with regard to the earth.

Figure 2:
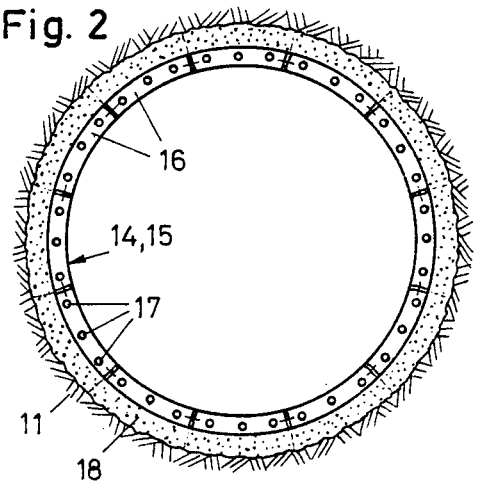
Figure 3:
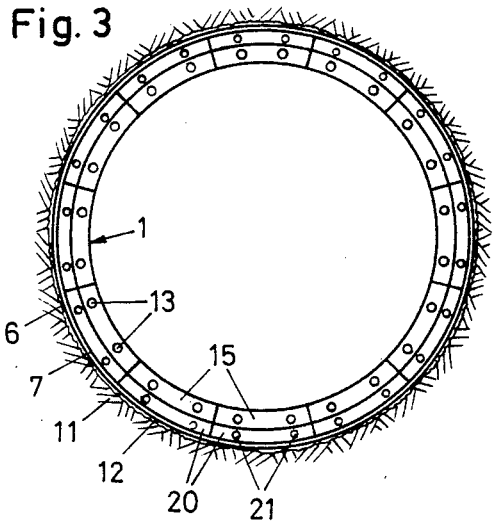
Figure 4:
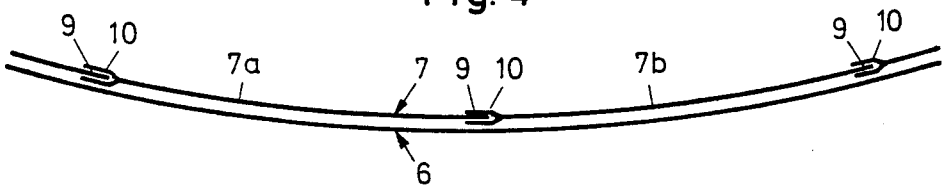
Figure 5:
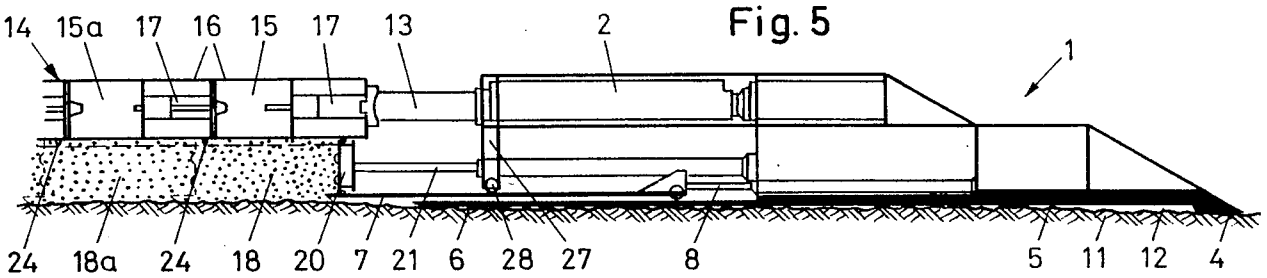
Figure 6:
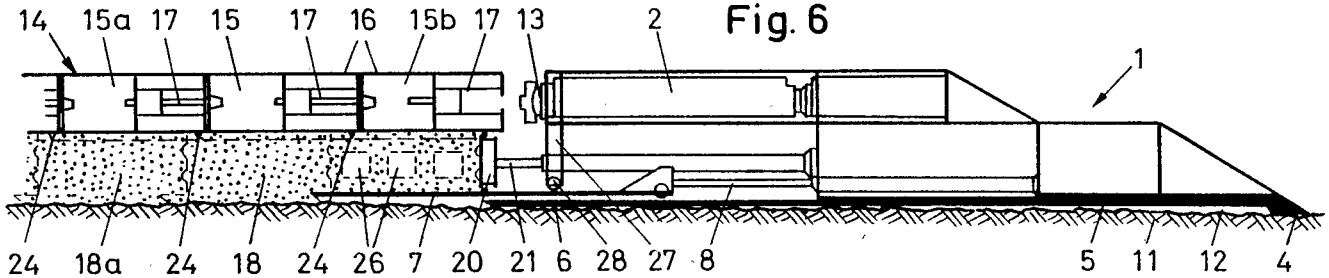
Figure 7:
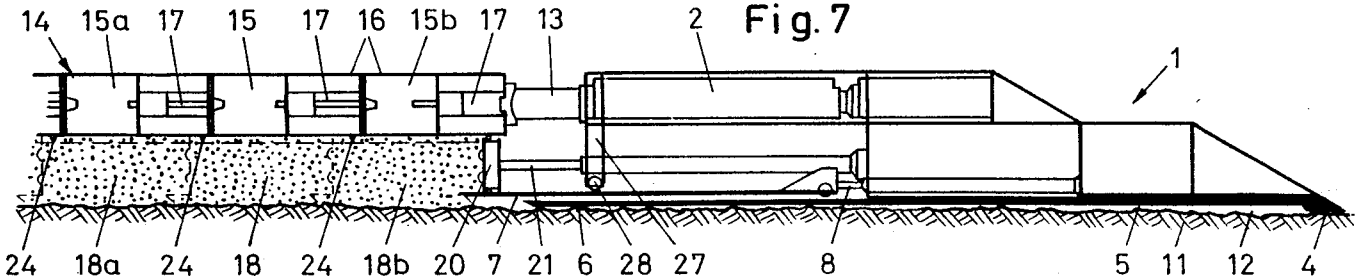
Figure 8:
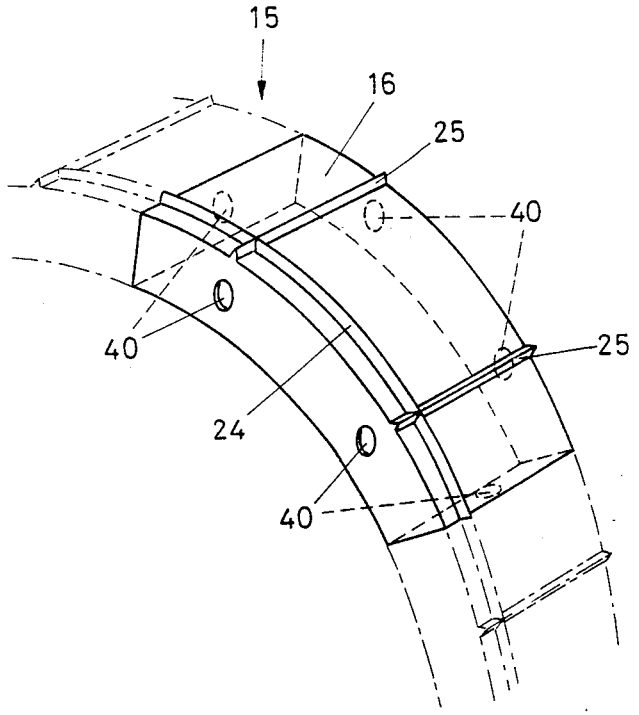
Figure 9:
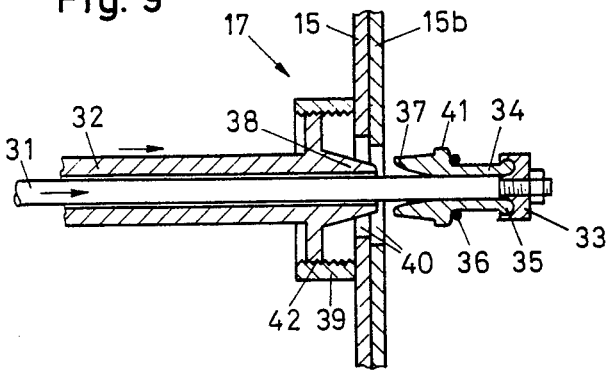
Figure 10:
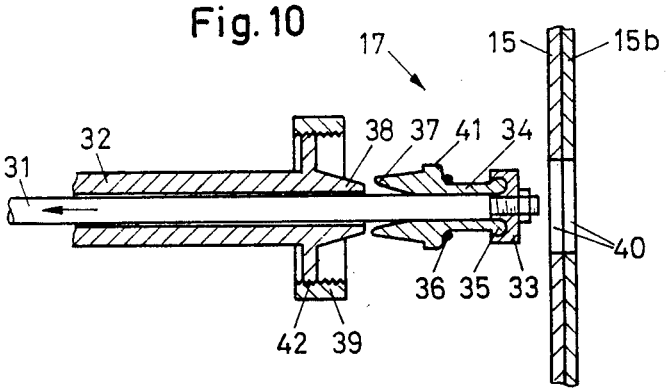
Figure 11:
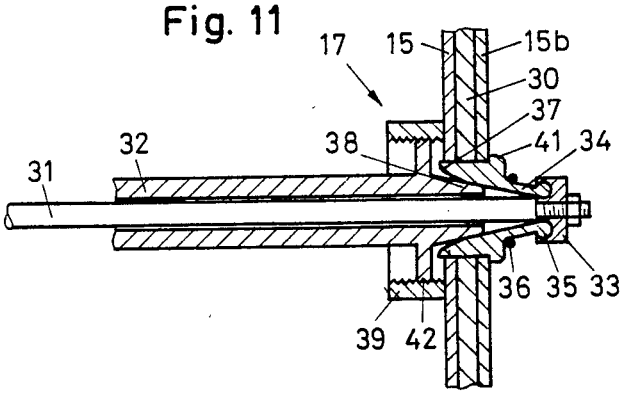
Figure 12:
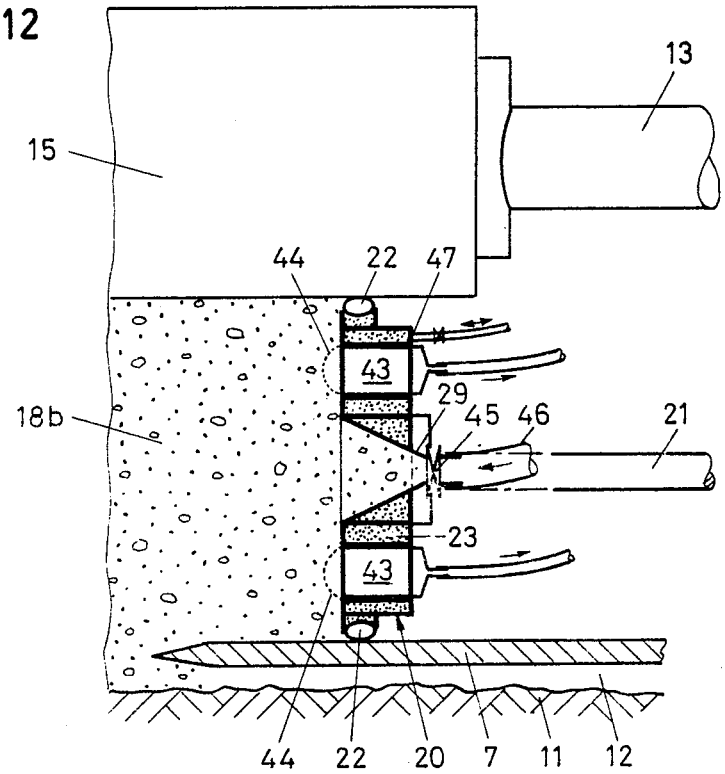
Figure 13:
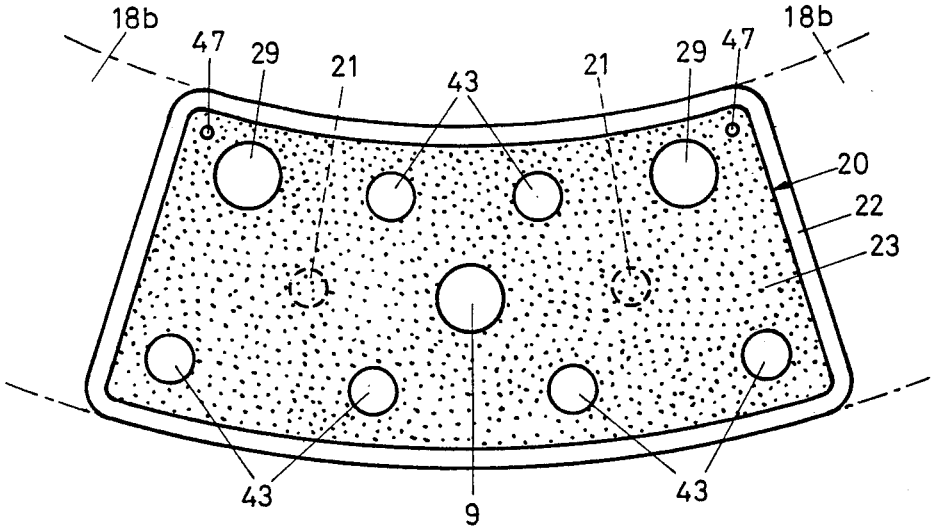

With the aid of the drawings an exemplary embodiment of the invention is described below in greater detail. Shown are:

FIG. 1—a longitudinal section through a tunnel construction apparatus which is placed in the tunnel in loose stone, FIG. 2—a cross section according to the line II—II through the apparatus according to FIG. 1, FIG. 3—a cross section according to the line III—III through the apparatus according to FIG. 1, FIG. 4—a section through the shield tail, in enlarged scale, FIGS. 5–7—a section through a portion of the tunnel construction apparatus, whereby three different operational stages are shown, FIG. 8—a single framing element in perspective view, FIG. 9—a section through an hydraulic coupling for connecting two framing elements, whereby the coupling is shown before being clamped, FIG. 10—the coupling according to FIG. 9 in the positioned condition, FIG. 11—the coupling according to FIG. 9 in tightened condition, adapted to a compensating ring arranged between the framing elements, FIG. 12—a section through the ram of the frontal framing, and FIG. 13—an elevational view of the ram member of the ram according to FIG. 12.

The tunnel construction apparatus has a cylindrical shield 1, which is pressed against the front wall 3 of the tunnel under excavation by means of drive presses 2. The shield 1 consists of the shield cutter 4, the shield casing 5 and the two-piece shield tail 6, 7. The one part 6 of the shield tail is rigidly connected with the shield casing 5 and moves therewith continually forward under the pressure of the drive presses 2. The movable shield tail element 7, which is divided into individual lamina 7*a*, 7*b* is arranged so as to be longitudinally shiftable relative to the shield casing 5, whereby each lamina 7*a*, 7*b* can be drawn forward individually by means of hydraulic shield tail presses 8 in the shield casing 5. Accordingly, the lamina sections are formed in such a manner that the longitudinal edge 9 of one lamina 7*a* is articulatedly guided in a longitudinal groove 10 at the edge of the adjacent lamina 7*b*.

The two shield tail elements 6, 7 are supported by means of the support 27 and the roller 28 on the frame of the shield casing.

In order to decrease wall friction during the drive of the shield, the diameter of the shield cutter 4 is somewhat larger than the diameter of the shield casing 5, so that a cylindrical hollow chamber 12 is present between the excavated earth 11 of the tunnel wall and the shield casing 5.

The pistons 13 of the hydraulic drive presses 2 are supported on the framing 14 following directly behind the shield 1. The framing 14 consists of a plurality of framing rings 15, 15*a*, 15*b*, which are connected with each other by means of couplings 17, and which, in turn, consist of a plurality of curved framing elements 16. Both the connection of the individual framing elements 16 among themselves and the connection of the framing rings 15, 15*a* with each other is accomplished with such hydraulic couplings 17.

The concrete 18, 18*a*, 18*b* brought in stages between the framing 14 and the earth, is advisably covered with a temporary insulation 19, in order to accelerate the hardening. For the same reason the framing 14 can also be provided with insulation 19.

The framing up of the frontal surface of the concrete is accomplished with a multi-segment ram 20, whose subdivision corresponds to the number of framing elements 16 of a framing ring 15. The support of the frontal framing against the concrete pressure is accomplished hydraulically by means of cylinders with piston 21 arranged on the shield casing 5. Each ram segment can be individually manipulated by means of a central control.

The ram segments 20 are sealed relative to the framing 14, the movable shield tail element 7 and among themselves by means of seals 22. They are formed as hollow box constructions so that their hollow chambers 23 can be charged with hot water, in order to obtain a rapid solidification of the concrete. The frontal surfaces of the ram 20 are also equipped with devices for vacuuming the concrete in the area of the frontal surfaces.

On the basis of FIGS. 5 through 7, the following explains the method of operations in tunnel construction with the above-described tunnel construction apparatus. The basic characteristics are to be seen in that the shield drive takes place continuously, while the lining is built in stages.

After construction of the concrete ring 18 (FIG. 5) there must be a certain waiting period which is dependent on reaching the necessary solidification of the fresh concrete. If necessary, this waiting period can be shortened by the use of preheated fresh concrete. For additional acceleration of the solidification, at least in the frontal area, the water is first partially drawn out by vacuuming the concrete, and subsequently the hollow chambers 23 in the ram are charged with hot water, in order to increase the solidification temperature. During this waiting period the digging operations at the front wall of the tunnel can continue. Under the pressure of the drive presses the shield 1 continues to move forward.

The pressure forces thus exerted on the framing 14 are transferred thereby onto the concrete lining. In order to increase the stationary friction between the framing and the lining, the framing 14 has annular ribs 24 which are arranged at a right angle to the axis of the tunnel and engage in the concrete. In addition to the annular ribs 24 longitudinal ribs 25 can also be provided so that the framed, finished lining is provided with a network of annular indentations and longitudinal indentations, to whose function reference was made in the introduction to the specification. During the solidification time of the concrete ring 18, the removal of the rear framing ring 15*b* can be undertaken. As soon as the concrete in the frontal area reaches a sufficient degree of solidification, the shield drive presses 2 and the ram presses 21 are drawn forward by one segment. If necessary, a reinforcement 26 of this segment can be put in place at this time.

The framing elements 16 of the rear framing ring 15*b* are now brought forward, and one element is coupled with the framing ring 15 (FIG. 6). The shield drive presses 2 are then run outward onto the newly mounted framing element. Then, in an analogous manner, the next framing element is mounted. Because the construction of the new framing ring 15*b* takes place in segments, there are always enough drive presses in operation to assure the continued progress of the shield.

The concreting of the new concrete ring 18*b* is also accomplished in segments, from the base above the sides alternating right and left, up to the crown. During the concreting of a segment the corresponding lamina of the movable shield tail element 7 is drawn into the shield casing 5, by which means the fresh concrete comes into contact with the earth of the tunnel wall (FIG. 7).

A subsequent filling of the fresh concrete can thus be avoided. The introduction of concrete is accomplished by pumps by way of connecting supports 29 on the ram 20 or on the framing 14. Because of the relatively small volume of about 1 to 2 $m^3$ of a concrete ring segment, the process requires only a few minutes, whereupon an immediate transition can be made until the crown is reached. Immediately after completion of the concreting, the vacuuming and heating of the frontal zones again begins, as described above.

The factors influencing the solidification of the concrete are selected in such a manner that the concrete reaches a minimum rigidity of, for example, 200 kg/cm$^2$ after about 16 hours, and can be unframed. At a drive velocity of 50 cm/h and a framing ring width of, for example, 1 m, the framing must consist of eight rings and a length of 8 m. Each framing ring effectively consists of 8 to 12 framing elements.

For periodically centering the arch axis with regard to the tunnel axis or to achieve a bend in the tunnel, narrow, conical ring plates 30 can be arranged between the individual framing rings. The respective constructional position of these ring plates is dependent on the tolerance values with regard to the tunnel axis and shield axis, i.e. is a function of the desired bend in the tunnel.

The framing elements 16 are all identical, with the exception of the base and the crown elements. The former is provided with a water drain device, and the latter is equipped with a tangential press device as a ring locking piece or framing depressurizing element.

For connecting the framing elements 16 and the framing rings 15 together the hydraulic coupling 17 was developed (FIGS. 9–11). This consists of a clamping rod 31, which is guided in a clamping sleeve 32 so as to be longitudinally shiftable. The end of the clamping rod 31 projects out of the clamping sleeve 32 and supports the screwed-on clamp head 33 and the multi-element spreading jaws 34. One end of the latter is hingedly (35) mounted in the clamping head 33. The other ends 37 of the jaws 34 facing the clamping sleeve 32 form a conical extension 37, which lies opposite the conical counter clamping head 38 at the end of the clamping sleeve 32. The coupling 17 is activated hydraulically and attached in the interior of the framing element 16 in a manner which is not described in greater detail. The entire unit can be completely driven into the framing element.

The connection of the new framing ring **15*b* with the already mounted framing ring 15 is accomplished, as mentioned, in segments. A new framing element of the ring 15*b* is brought into the correct position, and the coupling 17 from the neighboring framing element of the ring 15 is hydraulically driven out through the coupling openings 40, until the positioning ring 39 of the clamping sleeve 32 lies against the inner wall. The two coupling openings 40 do not have to align perfectly. The clamping head 33 with the spreading jaws 34 now projects into the interior of the new framing element. The clamping rod 31 is then drawn out, so that the counter clamping head 38 penetrates into the conical extension 37 of the spreading jaws 34 and presses the latter apart aginst the force of the surrounding annular spring 36. In this manner the two coupling openings 40 are automatically centered. The spread jaws 34 sit with their flange 41** on the inner wall of the new framing element.

The positioning ring 39 is connected with the clamping sleeve 32 by means of a thread 42, so that the distance of the jaw flange 41 from the positioning ring 39 can be adjusted, in order to be able, for example, to take into consideration a compensating ring 30 between the two framing rings 15, **15*b***.

To loosen the connection first the clamping rod 31 travels out and then the clamping sleeves and clamping rods are drawn together through the two openings 40 (FIG. 10).

On the basis of the FIGS. 12 and 13 details of the ram 20 of the frontal framing will now be explained. The seal 22 arranged on three sides of the individual ram member is effectively formed as an inflatable hollow seal, in order to compensate for the different tolerances between the ram 20 and the ring framing 14 or the movable shield tail element 7.

The vacuum bulbs 43, whose caps 44 are formed as strainers, are removably placed in corresponding openings in the ram. The vacuum bulbs must be easily removable and demountable for cleaning purposes.

The filling supports 29 with slides 45 for the pumped concrete are formed conically. The cones which remain in the concrete **18*b* after unframing form a toothed connection with the subsequent concrete ring. A number of filling supports 29 are provided, which can be selectively connected to the pump lines 46**.

The connection points for the hot water supply and return are designated with 47.

On the basis of FIG. 12 it can easily be seen how the fresh concrete fills the developing hollow chamber 12 as the movable shield tail 7 is drawn forward.

From an organizational point of view the following must be noted:

Because the shield drive moves continuously forward, and the excavation removal also operates continuously, a certain area for traffic in the center of the tunnel must be continually held free. For the framing mounting and unmounting operations as well as the concreting, lateral gaps are thus available. While no disadvantages arise from these spacial limitations for the pumping of the concrete, it should be remembered to have manageable segment elements for the framing. Similarly, the movable operational support frame is to be adapted to this space allocation.

The manipulations for the ring segment couplings are provided hydraulically-mechanically so that an effortless and rapid reframing is assured.

The devices for vacuuming and heat treating can be built into the shield structure, and so can the attachment and control of the hydraulically activated frontal segment ram and the movable shield tail construction.

The activation and control of the shield drive presses is accomplished by means of equipment built into the shield, like with the use of linings.

The proposed tunnel construction method causes basically no difficulties for manufacture. But in order to achieve large daily progress performances of about 10 to 12 m, a relatively high degree of mechanization of the two main operational groups of framing—unframing and concreting—subsequent treatment of the concrete are absolutely necessary.

What is claimed is:

1. A tunnel construction apparatus for cutting a tunnel and forming a concrete lining for a wall therein, said apparatus having a cylindrical tunnel shield with a cutter on the leading edge, a casing, a fixed tail and means for continuously moving said shield forwardly through the earth, characterized by:

an auxiliary movable tail extending rearwardly from said fixed tail, said auxiliary tail having a plurality of independently movable segments;

means for moving each of said auxiliary tail segments individually forwardly and rearwardly with respect to said shield, said auxiliary tail segments being moved rearwardly of the fixed tail to support the earth as the shield and fixed tail advance and said auxiliary tail segments being moved forwardly as the associated segment of a section of the tunnel wall is concreted;

a plurality of frontal concrete framing members, one associated with each of the segments of the auxiliary tail to define therewith an enclosure for concreting a segment of a section of the tunnel wall; and means for moving each of said frontal framing members individually forwardly and rearwardly with respect to said shield.

2. A tunnel construction system for cutting a tunnel and forming a concrete lining therein, including a cylindrical tunnel shield with a cutter on the leading edge, means for moving said shield through the earth and a plurality of internal framing rings for concreting the tunnel wall, characterized by:

a plurality of independently operable cylinders spaced around said shield, forming said shield moving means, said cylinders having pistons which bear on the framing ring adjacent thereto;

each of said internal framing rings comprising a plurality of ring segments whereby the piston of one of said plurality of cylinders may be retracted and an associated ring segment inserted behind the retracted piston while the remaining cylinders maintain movement of said shield;

a movable tail extending rearwardly from said tunnel shield and having a plurality of segments;

means for moving each of said tail segments individually forwardly and rearwardly with respect to said shield, said tail segments being moved rearwardly to support the earth as the shield advances and being moved forwardly as the associated segment of a section of the tunnel wall is concreted;

a plurality of frontal concrete framing members, one associated with each of the segments of the auxiliary tail to define therewith an enclosure for concreting a segment of a section of the tunnel wall; and means for moving each of said frontal framing members individually forwardly and rearwardly with respect to said shield.

* * * * *

UNITED STATES PATENT AND TRADEMARK OFFICE

CERTIFICATE OF CORRECTION

PATENT NO. : 4,557,627

DATED : December 10, 1985

INVENTOR(S) : WALTER A. SCHMID and HANS BERTSCHINGER

It is certified that error appears in the above-identified patent and that said Letters Patent is hereby corrected as shown below:

[73] Assignee: change "Locher & Cie AGZZ" to

-- Locher & Cie AG --.

Signed and Sealed this

*Twenty-fifth* Day of *March 1986*

[SEAL]

*Attest:*

DONALD J. QUIGG

*Attesting Officer*

*Commissioner of Patents and Trademarks*